US006454370B1

(12) United States Patent
Mosnik

(10) Patent No.: US 6,454,370 B1
(45) Date of Patent: Sep. 24, 2002

(54) COMPUTER ACCESSORY STAND DEVICE

(76) Inventor: Rod Mosnik, 9999 E. Yale Ave. Apt #A202, Denver, CO (US) 80231

( * ) Notice: Subject to any disclaimer, the term of this patent is extended or adjusted under 35 U.S.C. 154(b) by 0 days.

(21) Appl. No.: 09/671,902

(22) Filed: Sep. 28, 2000

(51) Int. Cl.[7] ..... A47B 81/00
(52) U.S. Cl. ..... 312/223.3; 312/323
(58) Field of Search ..... 312/223.3, 330.1, 312/323, 208.1; 248/917, 918; 108/50.01, 50.02

(56) References Cited

U.S. PATENT DOCUMENTS 621,059 A * 3/1899 Fuller
D139,024 S * 10/1944 Morando
3,794,401 A * 2/1974 Dean et al. ..... 312/323
4,600,249 A * 7/1986 Anderson ..... 312/223.3
4,600,250 A 7/1986 Windham
4,624,510 A 11/1986 Jedziniak
D287,080 S * 12/1986 Densen ..... D6/446
4,709,972 A * 12/1987 LaBudde et al. .... 312/223.3 X
5,020,449 A 6/1991 Forte
D334,304 S 3/1993 Gilman
5,467,952 A * 11/1995 Martin
5,481,987 A 1/1996 Maitland
5,685,441 A 11/1997 Calfee
6,042,075 A * 3/2000 Burch, Jr. ..... 248/918 X
6,168,250 B1 * 1/2001 Rogov ..... 312/323 X

* cited by examiner

*Primary Examiner*—Janet M. Wilkens

(57) ABSTRACT

A computer accessory stand device for organizing computer accessories. The computer accessory stand device includes a computer accessory stand designed for removably holding a computer monitor, a keyboard and accessories. The device comprises a housing which includes a bottom wall, a first side wall, a second side wall, a top wall, and a back wall such that the housing has an open front side. The housing also includes a plurality of intermediate walls that are spaced such that the front side of the housing has a plurality of compartments. The housing also includes a plurality of drawers. Each of the of drawers includes a bottom side, a front side, a back side, and two lateral sides such that each of the drawers has an open top side.

1 Claim, 3 Drawing Sheets

COMPUTER ACCESSORY STAND DEVICE

BACKGROUND OF THE INVENTION

1. Field of the Invention

The present invention relates to stands and more particularly pertains to a new computer accessory stand device for organizing computer accessories.

2. Description of the Prior Art

The use of stands is known in the prior art. More specifically, stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,600,250; U.S. Pat. No. 4,624,510; U.S. Pat. No. 5,020,449; U.S. Pat. No. 5,481,987; U.S. Pat. No. 5,685,441; and U.S. Pat. No. Des. 334,304.

While these devices fulfill their respective, particular objectives and requirements, the aforementioned patents do not disclose a new computer accessory stand device. The inventive device includes a computer accessory stand designed for removably holding a computer monitor, a keyboard and accessories. The device comprises a housing which includes a bottom wall, a first side wall, a second side wall, a top wall, and a back wall such that the housing has an open front side. The housing also includes a plurality of intermediate walls that are spaced such that the front side of the housing has a plurality of compartments. The housing also includes a plurality of drawers. Each of the of drawers includes a bottom side, a front side, a back side, and two lateral sides such that each of the drawers has a open top side.

In these respects, the computer accessory stand device according to the present invention substantially departs from the conventional concepts and designs of the prior art, and in so doing provides an apparatus primarily developed for the purpose of organizing computer accessories.

SUMMARY OF THE INVENTION

In view of the foregoing disadvantages inherent in the known types of stands now present in the prior art, the present invention provides a new computer accessory stand device construction wherein the same can be utilized for organizing computer accessories.

The general purpose of the present invention, which will be described subsequently in greater detail, is to provide a new computer accessory stand device apparatus and method which has many of the advantages of the stands mentioned heretofore and many novel features that result in a new computer accessory stand device which is not anticipated, rendered obvious, suggested, or even implied by any of the prior art stands, either alone or in any combination thereof.

To attain this, the present invention generally comprises a computer accessory stand designed for removably holding a computer monitor, a keyboard and accessories. The device comprises a housing which includes a bottom wall, a first side wall, a second side wall, a top wall, and a back wall such that the housing has an open front side. The housing also includes a plurality of intermediate walls that are spaced such that the front side of the housing has a plurality of compartments. The housing also includes a plurality of drawers. Each of the of drawers includes a bottom side, a front side, a back side, and two lateral sides such that each of the drawers has a open top side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new computer accessory stand device apparatus and method which has many of the advantages of the stands mentioned heretofore and many novel features that result in a new computer accessory stand device which is not anticipated, rendered obvious, suggested, or even implied by any of the prior art stands, either alone or in any combination thereof.

It is another object of the present invention to provide a new computer accessory stand device which may be easily and efficiently manufactured and marketed.

It is a further object of the present invention to provide a new computer accessory stand device which is of a durable and reliable construction.

An even further object of the present invention is to provide a new computer accessory stand device which is susceptible of a low cost of manufacture with regard to both materials and labor, and which accordingly is then susceptible of low prices of sale to the consuming public, thereby making such computer accessory stand device economically available to the buying public.

Still yet another object of the present invention is to provide a new computer accessory stand device which provides in the apparatuses and methods of the prior art some of the advantages thereof, while simultaneously overcoming some of the disadvantages normally associated therewith.

Still another object of the present invention is to provide a new computer accessory stand device for organizing computer accessories.

Yet another object of the present invention is to provide a new computer accessory stand device which includes a computer accessory stand designed for removably holding a computer monitor, a keyboard and accessories. The device comprises a housing which includes a bottom wall, a first side wall, a second side wall, a top wall, and a back wall such that the housing has an open front side. The housing also includes a plurality of intermediate walls that are spaced such that the front side of the housing has a plurality of compartments. The housing also has a plurality of drawers. Each of the of drawers includes a bottom side, a front side, a back side, and two lateral sides such that each of the drawers has a open top side.

Still yet another object of the present invention is to provide a new computer accessory stand device that provides an ergonomic device for users. The invention raises a user's monitor to eye level thereby lessening neck strain. The invention also provides a user with a plate for his or her keyboard.

Even still another object of the present invention is to provide a new computer accessory stand device that the invention provides a user with convenient organizational advantages. The invention provides a user with a plurality of locations to store both computer accessories and office accessories.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
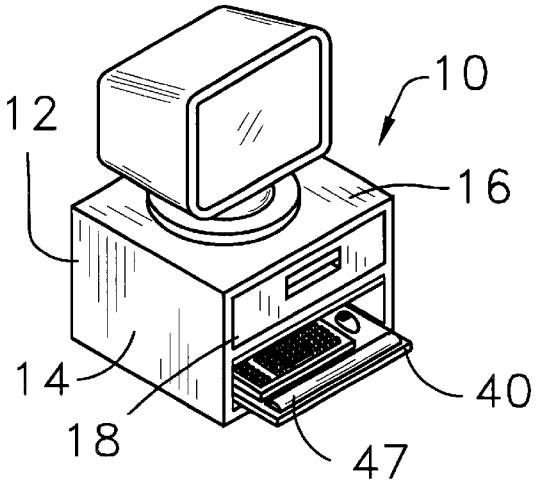
FIG. 1 is a schematic perspective view of a new computer accessory stand device according to the present invention.
Figure 2:
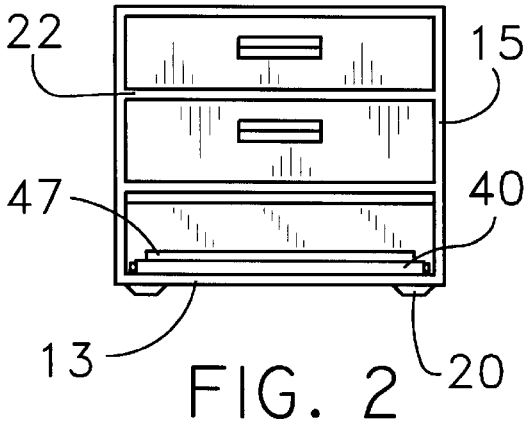
FIG. 2 is a schematic frontal view of the present invention showing a two drawer and keyboard plate embodiment.
Figure 3:
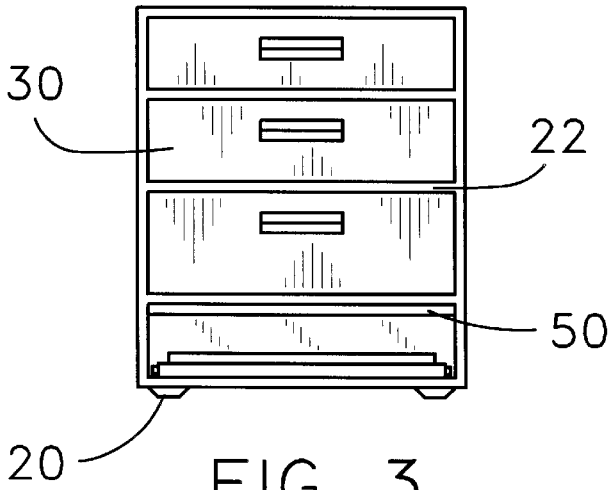
FIG. 3 is a schematic frontal view of the present invention showing a three-drawer and keyboard plate embodiment.
Figure 4:
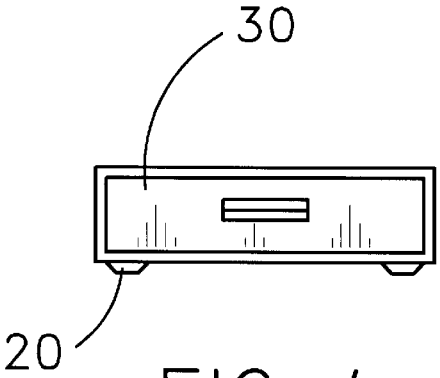
FIG. 4 is a schematic frontal view of the present invention showing a single-drawer embodiment with out a keyboard plate.
Figure 5:
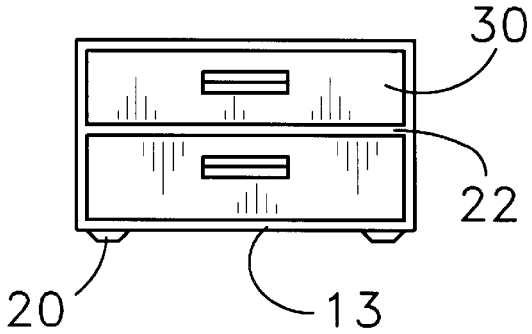
FIG. 5 is a schematic frontal view of the present invention showing a two-drawer embodiment without a keyboard plate.
Figure 6:
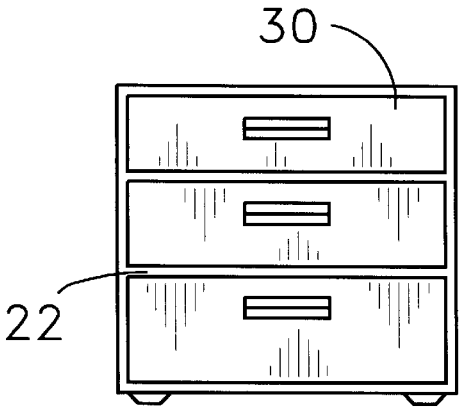
FIG. 6 is a schematic frontal view of the present invention showing a three-drawer embodiment without a keyboard plate.
Figure 8:
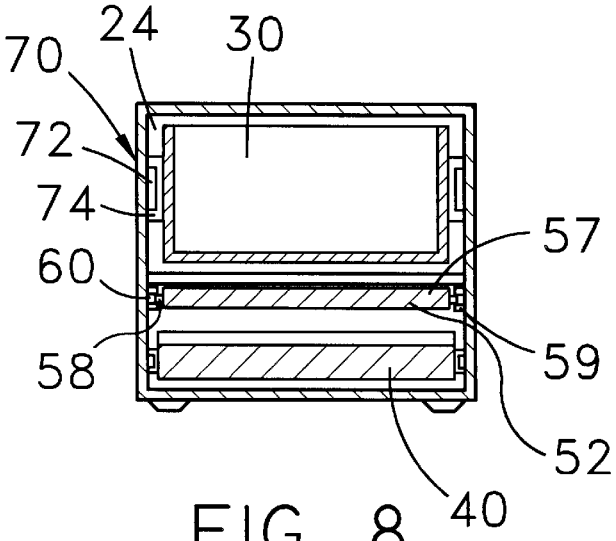
FIG. 8 is a schematic cross-sectional view of the present invention taken along line 8—8 of FIG. 7.
Figure 7:
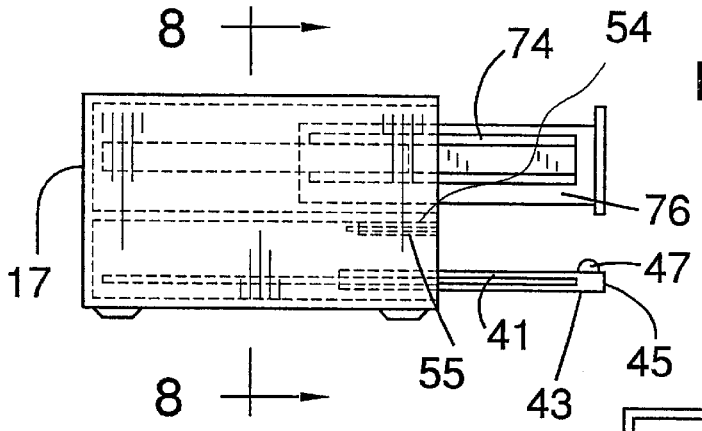
FIG. 7 is a schematic side view of the present invention showing the sliding members.
Figure 9:
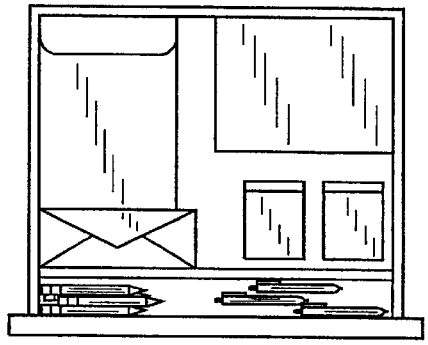
FIG. 9 is a schematic top view of the present invention showing a pen drawer embodiment.
Figure 10:
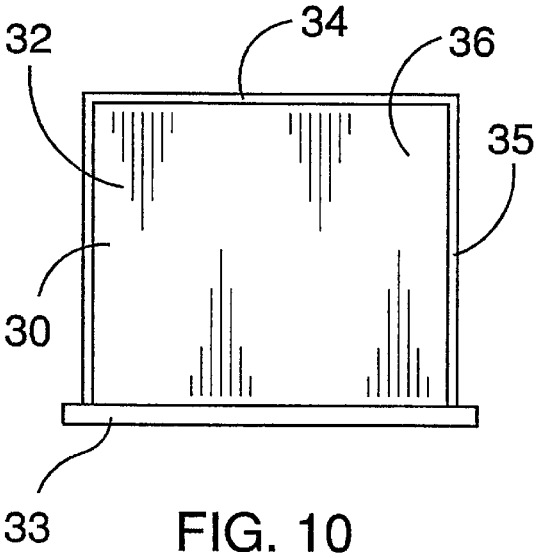
FIG. 10 is a schematic top view of the present invention showing a envelope drawer embodiment.
Figure 11:
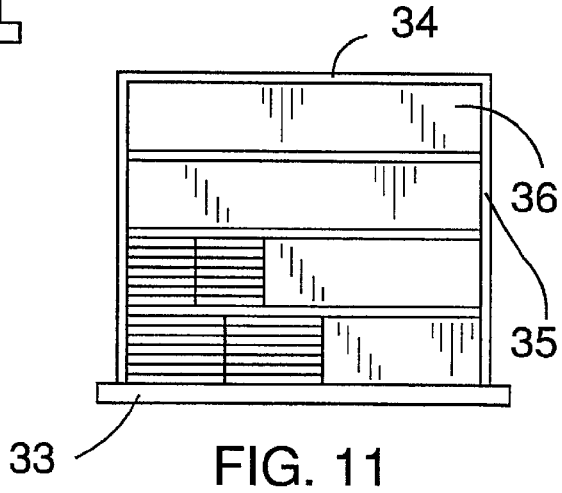
FIG. 11 is a schematic top view of the present invention showing a media drawer embodiment.

With reference now to the drawings, and in particular to FIGS. 1 through 6 thereof, a new computer accessory stand device embodying the principles and concepts of the present invention and generally designated by the reference numeral 10 will be described.

As best illustrated in FIGS. 1 through 6, the computer accessory stand device 10 generally comprises a computer accessory stand designed for removably holding a computer monitor, a keyboard and accessories. The device comprising a housing 12 which includes a bottom wall 13, a first side wall 14, a second side wall 15, a top wall 16, and a back wall 17 such that the housing 12 has an open front side 18.

The bottom wall 13 has a plurality foot portions 20. Each of the foot portions 20 is securably attached to the bottom wall 17 and extending downwardly therefrom.

In the housing 12 there is a plurality of intermediate walls 22. Each of the intermediate walls 22 generally extends between and is securably coupled to the first side wall 14 and the second side wall 15. The intermediate walls 22 are spaced such that a plurality of compartments 24 is defined extending into the front side 18. The plurality of intermediate walls 22 is two. Other embodiments may have only one or as many as three intermediate walls 22. However, there may also be embodiments having more than three intermediate walls 22.

Positioned between the intermediate walls 22 is a plurality of drawers 30. Each of the of drawers 30 includes a bottom side 32, a front side 33, a back side 34, and two lateral sides 35 such that each of the drawers 30 has a open top side 36. Each of the drawers 30 includes a size designed for movably positioning in one of the compartments 24 of the housing 12.

The housing 12 also has a plate 40. The plate 40 includes a top surface 41, a bottom surface 43 and a peripheral edge 45 extending therebetween. The plate 40 is extendably positioned in one of the compartments 24 of the housing 12. The plate 40 includes a padded portion 47 removably coupled to the top surface 41. The padded portion 47 may be made of a resiliently flexible material such as gel or foam. In an embodiment a keyboard is positioned on the top surface 41 of the plate. Other embodiments of the present invention can be made without the plate 40.

To cover the plate there is a door 50. The door 50 comprises a panel 52 that includes a first side 54, a second side 55 and a peripheral edge 57 therebetween. The peripheral edge 57 includes a pair of nubs 58 integrally coupled to and extending therefrom. There is also a pair of elongated brackets 59. Each of the brackets 59 includes a notch 60 for receiving the nub 58. Each of the brackets 59 is securably coupled to an inner surface 62 of one of the compartments 24 of the housing 12. The pair of brackets 59 is positioned on opposite sides of the compartment 24. In an embodiment the door 50 may be movably extendable in one of the compartments 24.

To help move the drawers 30 there are a plurality of sets of sliding members 70. Each of the sets 70 comprising a pair of male slide rails 72. Each of the male slide rails 72 is securably coupled to the inner surface 62 of one of the compartments 24 such that the pair of male slide rails 72 is positioned on opposite sides of one of the compartments 24.

The sets of sliding members 70 also include a pair of female slide rails 74. Each of the female slide rails 74 is securably coupled to an outer surface 76 of the pair of lateral side walls 35 of the plurality of drawers 30. The pair of female slide rails 70 is positioned on opposite sides of one of the drawers 30.

In an embodiment a set of the sliding members 70 is located in one of the compartments 24.

In use, a monitor is set on the top wall 16 of the housing 12. Depending on the number of drawers 30 chosen by a user, the monitor will be set at a certain height. A user may use the plurality of drawers 30 for storing such things as pens, envelops, computer accessories. A user may also open the door 50, which is stored in the compartment 24, to pull out the plate 40 and use his or her keyboard. Once the user is done using the keyboard he or she may push the plate 40 back into the compartment 24 and pull out the door 50, covering the plate 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A computer accessory stand for removably holding a computer monitor, a keyboard and accessories, said stand comprising:

a housing having a bottom wall, a first side wall, a second side wall, a top wall, and a back wall such that said housing has an open front side;

an intermediate wall positioned between said top and bottom walls to define a plurality of compartments accessible through said front side, said plurality of compartments including a lowermost compartment and an intermediate compartment immediately above said lowermost compartment;

a drawer having an interior for receiving and storing items between uses of the items, said drawer having a bottom side, a front side, a back side, and two lateral sides such that said drawer has an open top, said drawer being slidably mounted in said intermediate compartment such that said drawer is selectively extendable from an interior of said intermediate compartment;

a keyboard tray slidably mounted in said lowermost compartment such that said keyboard tray is selectively extendable from an interior of said lowermost compartment; and a door slidably mounted in said lowermost compartment, said door being slidably extendable from said lowermost compartment to close a forward opening of said lowermost compartment, said door being positioned in said lowermost compartment at a location above said keyboard tray and below said intermediate compartment such that said drawer is accessible for slidable movement from said intermediate compartment when said door closes said forward opening of said lowermost compartment;

a plurality of foot portions, each of said foot portions being attached to said bottom wall and extending downwardly therefrom;

wherein said intermediate wall generally extends between and is coupled to said first and second walls, said intermediate wall being spaced such that said plurality of compartments are defined extending into said front side;

wherein two of said intermediate walls are positioned between said top and bottom walls to define three of said compartments;

said drawer having a handle on said front side wherein said drawer may be opened and closed;

wherein said keyboard tray has a padded portion on a top surface of said keyboard tray, said padded portion being oriented generally adjacent to a peripheral edge of said keyboard tray;

wherein said door has a first side, a second side and a peripheral edge therebetween said peripheral edge having a pair of nubs integrally coupled to and extending therefrom, a pair of elongated brackets, each of said brackets having a notch for receiving said nub, each of said brackets being coupled to an inner surface of said lowermost compartment of said housing, said pair of brackets being positioned on opposite sides of said lowermost compartment; and a pair of male slide rails, each of said male slide rails being coupled to said inner surface of said intermediate compartment such that said pair of male slide rails are positioned on opposite sides of said intermediate compartment;

a pair of female slide rails, each of said female slide rails being coupled to an outer surface of said drawer such that each of said pair of female slide rails are positioned on one of said sides of said drawer.

* * * * *